US011504963B2

(12) United States Patent
Biegelsen

(10) Patent No.: US 11,504,963 B2
(45) Date of Patent: Nov. 22, 2022

(54) FOUNTAIN SOLUTION IMAGING AND TRANSFER USING DIELECTROPHORESIS

(71) Applicant: Palo Alto Research Center Incorporated, Palo Alto, CA (US)

(72) Inventor: David K. Biegelsen, Portola Valley, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 32 days.

(21) Appl. No.: 17/152,538

(22) Filed: Jan. 19, 2021

(65) Prior Publication Data

US 2022/0227124 A1 Jul. 21, 2022

(51) Int. Cl.
*B41F 31/13* (2006.01)

(52) U.S. Cl.
CPC ..... *B41F 31/13* (2013.01)

(58) Field of Classification Search
CPC ..... B41F 31/13; B41P 2227/70; Y10S 101/37
See application file for complete search history.

(56) References Cited

U.S. PATENT DOCUMENTS 2,551,582 A 5/1951 Carlson
8,958,723 B2 2/2015 Liu
9,316,993 B2 * 4/2016 Veres ..... B41M 1/06
10,744,754 B2 8/2020 Williams et al.
2013/0033686 A1 2/2013 Stowe et al.
2014/0013980 A1 1/2014 Veres et al.
2017/0217150 A1 8/2017 Moore et al.

OTHER PUBLICATIONS

Co-pending U.S. Appl. No. 17/152,630, filed Jan. 19, 2021.
Co-pending U.S. Appl. No. 17/152,597, filed Jan. 19, 2021.
Co-pending U.S. Appl. No. 17/152,574, filed Jan. 19, 2021.
European Search Report to related European Patent Application No. 19185256.5 dated Jan. 13, 2020.

* cited by examiner

*Primary Examiner* — Leslie J Evanisko
*Assistant Examiner* — Leo T Hinze
(74) *Attorney, Agent, or Firm* — Caesar Rivise, PC

(57) ABSTRACT

A compliant surface is created with micron scale pits or dimples above an electrically biased conductive layer. The dimples are filled partially with fountain solution and brought adjacent a surface bearing a charge image. The field lines between pixel charge and backplane conductive layer are guided by the dielectric variations defined by the dimple walls and the fountain solution. Dielectrophoretic forces cause the fountain solution within the dimples to flow up to the charge image and wet the surface. A desired volume is controlled by varying parameters such as nip pressure. The developed latent image is then brought into contact with a transfer member blanket and split, thus creating on the blanket a fountain solution latent image ready for inking.

20 Claims, 5 Drawing Sheets

FOUNTAIN SOLUTION IMAGING AND TRANSFER USING DIELECTROPHORESIS

FIELD OF DISCLOSURE

The present disclosure is related to marking and printing systems, and more specifically to variable data lithography system using fog development of an electrographic image for creating a fountain solution image.

BACKGROUND

Offset lithography is a common method of printing today. For the purpose hereof, the terms "printing" and "marking" are interchangeable. In a typical lithographic process a printing plate, which may be a flat plate, the surface of a cylinder, belt and the like, is formed to have image regions formed of hydrophobic and oleophilic material, and non-image regions formed of a hydrophilic material. The image regions are regions corresponding to areas on a final print (i.e., the target substrate) that are occupied by a printing or a marking material such as ink, whereas the non-image regions are regions corresponding to areas on the final print that are not occupied by the marking material.

Digital printing is generally understood to refer to systems and methods of variable data lithography, in which images may be varied among consecutively printed images or pages. "Variable data lithography printing," or "ink-based digital printing," or "digital offset printing" are terms generally referring to printing of variable image data for producing images on a plurality of image receiving media substrates, the images being changeable with each subsequent rendering of an image on an image receiving media substrate in an image forming process. "Variable data lithographic printing" includes offset printing of ink images generally using specially-formulated lithographic inks, the images being based on digital image data that may vary from image to image, such as, for example, between cycles of an imaging member having a reimageable surface. Examples are disclosed in U.S. Patent Application Publication No. 2012/0103212 A1 (the '212 Publication) published May 3, 2012 based on U.S. patent application Ser. No. 13/095,714, and U.S. Patent Application Publication No. 2012/0103221 A1 (the '221 Publication) also published May 3, 2012 based on U.S. patent application Ser. No. 13/095,778.

A variable data lithography (also referred to as digital lithography) printing process usually begins with a fountain solution used to dampen a silicone imaging plate or blanket on an imaging drum. The fountain solution forms a film on the silicone plate that is on the order of about one (1) micron thick. The drum rotates to an exposure station where a high-power laser imager is used to remove the fountain solution at locations where image pixels are to be formed. This forms a fountain solution based latent image. The drum then further rotates to an inking station where lithographic-like ink is brought into contact with the fountain solution based latent image and ink transfers into places where the laser has removed the fountain solution. The ink is usually hydrophobic for better adhesion on the plate and substrate. An ultraviolet (UV) light may be applied so that photo-initiators in the ink may partially cure the ink to prepare it for high efficiency transfer to a print media such as paper. The drum then rotates to a transfer station where the ink is transferred to a print substrate such as paper. The silicone plate is compliant, so an offset blanket is not needed to aid transfer. UV light may be applied to the paper with ink to fully cure the ink on the paper. The ink is on the order of one (1) micron pile height on the paper.

The formation of the image on the printing plate/blanket is usually done with imaging modules each using a linear output high power infrared (IR) laser to illuminate a digital light projector (DLP) multi-mirror array, also referred to as the "DMD" (Digital Micromirror Device). The laser provides constant illumination to the mirror array. The mirror array deflects individual mirrors to form the pixels on the image plane to pixel-wise evaporate the fountain solution on the silicone plate to create the fountain solution latent image.

Due to the need to evaporate the fountain solution to form the latent image, power consumption of the laser accounts for the majority of total power consumption of the whole system. The laser power that is required to create the digital pattern on the imaging drum via thermal evaporation of the fountain solution to create a latent image is particularly demanding (30 mW per 20 um pixel, ~500 W in total). The high power laser module adds a significant cost to the system; it also limits the achievable print speed to about five meters per second (5 m/s) and may compromise the lifetime of the exposed components (e.g., micro-mirror array, imaging blanket, plate, or drum).

For the reasons stated above, and for other reasons which will become apparent to those skilled in the art upon reading and understanding the present specification, it would be beneficial to increase speed and lower power consumption in variable data lithography systems while improving fountain solution deposition.

SUMMARY

The following presents a simplified summary in order to provide a basic understanding of some aspects of one or more embodiments or examples of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later. Additional goals and advantages will become more evident in the description of the figures, the detailed description of the disclosure, and the claims.

The foregoing and/or other aspects and utilities embodied in the present disclosure may be achieved by providing a fountain solution delivery device for delivering fountain solution onto a target having a charge-retentive surface bearing an electrostatic charged pattern of charged regions thereon. The delivery device includes a fountain solution transfer member and a metering member. The fountain solution transfer member includes a textured compliant surface layer of a first depth wrapped around a conductive layer. The textured compliant surface layer has lands at a top surface thereof and dimples therein configured to receive and carry the fountain solution. The conductive layer has a reference potential, and each dimple has a volume. The textured compliant surface layer also has fountain solution filling the dimples thereon. The metering member is in contact with the fountain solution transfer member and is configured to meter fountain solution quantity in the dimples to less than the volume of the dimples leaving gaps in the dimples between the fountain solution and the top surface. The fountain solution transfer member is rotatable adjacent the charge retentive surface at the charged regions of the electrostatic charged pattern, with the charged regions and the conductive layer creating a non-uniform electric field therebetween due to field concentration in the textured compliant surface layer. The charged regions in the non-uniform electric field dielectrophoretically pull the fountain solution in the dimples across the gaps to wet the charge retentive surface at the electrostatic charged pattern and form a patterned fountain solution latent image on the charge-retentive surface based on the electrostatic charged pattern.

According to aspects described herein, an imaging system is described. The imaging system is useful for printing with an ink-based image forming apparatus having a rotatable imaging member with a charge-retentive surface bearing an electrostatic charged pattern of charged regions thereon. The imaging system includes an image forming unit, a fountain solution transfer member and a metering member. The image forming unit is adjacent the charge-retentive reimageable surface that forms the electrostatic charged pattern on the surface. The fountain solution transfer member includes a textured compliant surface layer of a first depth wrapped around a conductive layer, with the textured compliant surface layer having lands at a top surface thereof and dimples therein configured to receive and carry the fountain solution. The conductive layer has a reference potential, and each dimple has a volume. The textured compliant surface layer has fountain solution filling the dimples thereon. The metering member is in contact with the fountain solution transfer member and is configured to meter fountain solution quantity in the dimples to less than the volume of the dimples leaving gaps in the dimples between the fountain solution and the top surface. The fountain solution transfer member is rotatable adjacent the charge retentive surface at the charged regions of the electrostatic charged pattern, with the charged regions and the conductive layer creating a non-uniform electric field therebetween due to field concentration in the textured compliant surface layer. The charged regions in the non-uniform electric field dielectrophoretically pull the fountain solution in the dimples across the gaps to wet the charge retentive surface at the electrostatic charged pattern and form a patterned fountain solution latent image on the charge-retentive surface based on the electrostatic charged pattern.

According to aspects illustrated herein, an exemplary method for delivering fountain solution onto a target having a charge-retentive surface bearing an electrostatic charged pattern of charged regions thereon. The method includes: a) supplying fountain solution to a fountain solution transfer member having a textured compliant surface layer of a first depth wrapped around a conductive layer, the textured compliant surface layer having lands at a top surface thereof and dimples therein configured to receive and carry the fountain solution, the conductive layer having a reference potential, each dimple having a volume; b) metering fountain solution quantity into the dimples to less than the volume of the dimples leaving gaps in the dimples between the fountain solution and the top surface; c) rotating the lands of the textured compliant surface adjacent the charge retentive surface; d) creating a non-uniform electric field due to field concentration in the textured compliant surface layer between the charged regions of the electrostatic charged pattern and the conductive layer; and e) the charged regions in the non-uniform electric field dielectrophoretically pulling the fountain solution in the dimples across the gaps to wet the charge retentive surface at the electrostatic charged pattern and forming a patterned fountain solution latent image on the charge-retentive surface based on the electrostatic charged pattern.

Exemplary embodiments are described herein. It is envisioned, however, that any system that incorporates features of apparatus and systems described herein are encompassed by the scope and spirit of the exemplary embodiments.

BRIEF DESCRIPTION OF THE DRAWINGS

Various exemplary embodiments of the disclosed apparatuses, mechanisms and methods will be described, in detail, with reference to the following drawings, in which like referenced numerals designate similar or identical elements, and.

DETAILED DESCRIPTION OF THE INVENTION

Figure 1:
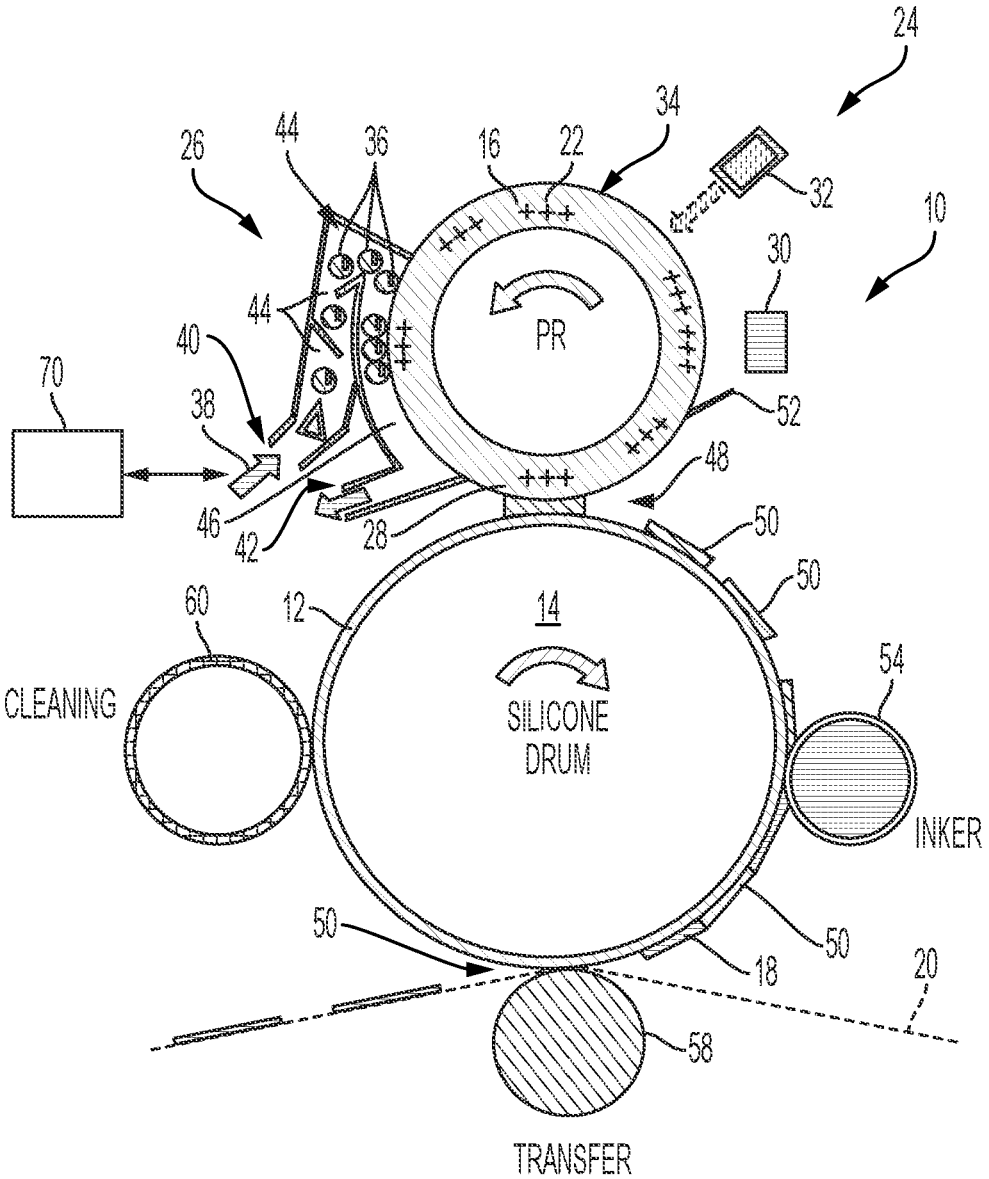
FIG. 1 illustrates a diagram of a related art ink-based digital printing system.

Illustrative examples of the devices, systems, and methods disclosed herein are provided below. An embodiment of the devices, systems, and methods may include any one or more, and any combination of, the examples described below. This invention may, however, be embodied in many different forms and should not be construed as limited to the embodiments set forth below. Rather, these exemplary embodiments are provided so that this disclosure will be thorough and complete, and will fully convey the scope of the invention to those skilled in the art. Accordingly, the exemplary embodiments are intended to cover all alternatives, modifications, and equivalents as may be included within the spirit and scope of the apparatuses, mechanisms and methods as described herein.

We initially point out that description of well-known starting materials, processing techniques, components, equipment and other well-known details may merely be summarized or are omitted so as not to unnecessarily obscure the details of the present disclosure. Thus, where details are otherwise well known, we leave it to the application of the present disclosure to suggest or dictate choices relating to those details. The drawings depict various examples related to embodiments of illustrative methods, apparatus, and systems for inking from an inking member to the reimageable surface of a digital imaging member.

When referring to any numerical range of values herein, such ranges are understood to include each and every number and/or fraction between the stated range minimum and maximum. For example, a range of 0.5-6% would expressly include the endpoints 0.5% and 6%, plus all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

The term "controller" or "control system" is used herein generally to describe various apparatus such as a computing device relating to the operation of one or more device that directs or regulates a process or machine. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

The terms "media", "print media", "print substrate" and "print sheet" generally refers to a usually flexible physical sheet of paper, polymer, Mylar material, plastic, or other suitable physical print media substrate, sheets, webs, etc., for images, whether precut or web fed. The listed terms "media", "print media", "print substrate" and "print sheet" may also include woven fabrics, non-woven fabrics, metal films, and foils, as readily understood by a skilled artisan.

The term "image forming device", "printing device" or "printing system" as used herein may refer to a digital copier or printer, scanner, image printing machine, xerographic device, electrostatographic device, digital production press, document processing system, image reproduction machine, bookmaking machine, facsimile machine, multi-function machine, or generally an apparatus useful in performing a print process or the like and can include several marking engines, feed mechanism, scanning assembly as well as other print media processing units, such as paper feeders, finishers, and the like. A "printing system" may handle sheets, webs, substrates, and the like. A printing system can place marks on any surface, and the like, and is any machine that reads marks on input sheets; or any combination of such machines.

The term "fountain solution" or "dampening fluid" refers to dampening fluid that may coat or cover a surface of a structure (e.g., imaging member, transfer roll) of an image forming device to affect connection of a marking material (e.g., ink, toner, pigmented or dyed particles or fluid) to the surface. The fountain solution may include water optionally with small amounts of additives (e.g., isopropyl alcohol, ethanol) added to reduce surface tension as well as to lower evaporation energy necessary to support subsequent laser patterning. Low surface energy solvents, for example volatile silicone oils, can also serve as fountain solutions. Fountain solutions may also include wetting surfactants, such as silicone glycol copolymers. The fountain solution may be non-aqueous including, for example, silicone fluids (such as D3, D4, D5, OS10, OS20, OS30 and the like), Isopar fluids, and polyfluorinated ether or fluorinated silicone fluid.

The term "aerosol" refers to a suspension of solid and/or liquid particles in a gas. An aerosol may include both the particles and the suspending gas, which may be air, another gas or mixture thereof. The solids and/or liquid particles are sufficiently large for sedimentation, for example, as fountain solution on an imaging member surface. For example, solid or liquid particles may be greater than 0.1 micron, less than 5 microns, between about 0.5 and 2 microns and about 1 micron in diameter.

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," and the like, herein do not denote any order, quantity, or importance, but rather are used to distinguish one element from another. The terms "a" and "an" herein do not denote a limitation of quantity, but rather denote the presence of at least one of the referenced item.

FIG. 1 depicts an exemplary related art ink-based digital image forming apparatus 10 for variable data lithography including fog development of a charged fountain solution aerosol that forms a latent digital image created electrographically. The latent digital image is transferred to an inking blanket 12 of a transfer member 14 (e.g., roller, cylinder, drum) downstream an imaging member 16 for subsequent printing of an associated ink image 18 onto a print substrate 20. The imaging member 16 shown in FIG. 1 is a drum, but this exemplary depiction should not be read in a manner that precludes the imaging member 16 being a blanket, a belt, or of another known configuration. The image forming apparatus 10 includes the rotatable imaging member 16 having an arbitrarily reimageable surface 22 as different images can be created on the surface layer. In examples, the surface 22 is a charge-retentive surface such as but not limited to a photoreceptor surface or a dielectric surface. The reimageable charge-retentive surface 22 may be part of the drum or formed over a structural mounting layer that may be, for example, a cylindrical core, or one or more structural layers over a cylindrical core. The reimageable charge-retentive surface may be formed of a relatively thin layer over the mounting layer, a thickness of the relatively thin layer being selected to balance charge retaining performance, durability and manufacturability. The imaging member 16 is surrounded by an imaging station 24 configured to form an electrostatic charged pattern of a latent image on the imaging member surface 22, and an aerosol development device 26 that provides a fog of charged fountain solution aerosol particles that are attracted to the electrostatic charged pattern.

According to examples, fountain solution latent images 28 are created (e.g., xerographically, ionographically) on imaging member 16 and transferred to the inking blanket 12 for further processing. At the imaging station 24, a charging device 30 charges the imaging member surface 22, for example by corona discharge from a high voltage power source via a conductor of the charging device adjacent the charge-retentive imaging member surface 22. In electrography or xerography an imager 32 having a low power light source (e.g., a laser with a conventional ROS scanner, LED bar) selectively discharges select portions or pixels of the surface 22 according to image data to generate an electrostatic charged pattern 34 disposed on the surface of the imaging member 20. In ionography the imager 32 includes an image projection head for projecting ion beams, i.e., ions of a given polarity, onto the charge-retentive surface 22 after the surface is charged by the charging device 30. The surface 22 shown could be a photoreceptor, but when the application is ionographically created, an insulating surface could be used to create the charge image.

The aerosol development device 26 presents a charged patterned uniform layer of fountain solution (e.g., silicone fluids, such as D4, D5, Isopar G, Isopar H, Dowsil OS20, Dowsil OS30, L5; water/IPA mixtures, hydrophilic fluids, and mixtures thereof) aerosol particles 36 in solid or liquid particle form onto the surface 22 of the imaging member 16. The fountain solution aerosol particles 36 are configured to adhere to portions of the imaging member surface 22 according to the electrostatic charged pattern 34 developed thereon by imager 32. In examples, charged fountain solution aerosol particles 36 of opposite polarity of the imaging member surface 22 are deposited onto the electrostatic charged pattern 34, forming a fountain solution latent image 28 on the imaging member surface. In other examples, charged fountain solution aerosol particles 36 of the same polarity as the imaging member surface 22 would be deposited on the neutral pixels thereof.

The aerosol development device 26 atomizes and charges fountain solution 38 into charged fountain solution aerosol particles 36 that enter an inlet port 40. In examples, a pump may supply fountain solution from a container housing the fountain solution to an aerosol generator (e.g., a nebulizer) at a steady, controlled rate. The fountain solution may contain charge control agents (e.g., surfactants, polymer solution, salts), to assist particle charging, as well understood by a skilled artisan. The aerosol development device 26 further includes a manifold having walls 62 defining a chamber 44 and a radially enlarged region 46 near the imaging member surface 22 where a fog of charged fountain solution aerosol particles 36 may carry the atomized fountain solution to the electrostatic charged pattern 34 on the surface of imaging member 16.

A carrier gas such as nitrogen, added in a predetermined amount, may be introduced into the developer unit chamber 44 via inlet port 40 to carry the atomized fountain solution aerosol particles 36 to the surface 22 of imaging member 16 as a gas mixture, where they may be attracted to the electrostatic charged pattern 34 and bond to the charge-retentive reimageable surface 22 and form a fountain solution latent image 28. The gas mixture transporting the atomized fountain solution aerosol particles includes the carrier gas and a controlled partial pressure of fountain solution. This partial pressure of fountain solution may solely originate from evaporated fountain solution or a controlled additional vaporized fountain solution. An increase in the partial pressure of the fountain solution will slow down the evaporation from the fountain solution droplets. The partial pressure may be modified, for example, by the controller adding vaporized fountain solution to the gas mixture, as well understood by a skilled artisan.

The surface charge density (created by charging device 30) of the latent image attracts a volume of fountain solution aerosol particles 36 until the surface charge is optionally neutralized or partially neutralized by the fog charged aerosol. Adhesion forces with the imaging member 16 and each other will cause the aerosol particles to remain on the surface 22 of the imaging member.

Aerosol particles 36 do not bond to the surface 22 of imaging member 16 where no latent image charge resides. The aerosol particles 36 can also be electrostatically repelled from uncharged regions of the electrostatic charged pattern 34, for example, via voltage applied to walls of the development device 26. Aerosol particles 36 that do not bond to the imaging member surface 22 may exit the developer unit 20 via outlet port 42 and flow back to the fountain solution container. A vapor vacuum or air knife (not shown) may be positioned adjacent the downstream side of the radially enlarged region 46 near the outlet port 42 to collect unattached aerosol particles and thus avoid leakage of fountain solution into the environment. Reclaimed fountain solution particles can also be condensed and filtered as needed for reuse as understood by a skilled artisan to help minimize the overall use of fountain solution by the image forming device 10.

The transfer member 14 may be configured to form a fountain solution image transfer nip 48 with the imaging member 16. A fountain solution image produced by the developer unit 26 and imaging station 24 on the surface 22 of the imaging member 16 is transferred to the inking blanket 12 of the transfer member 14 under pressure at the loading nip 48. In particular, a light pressure (e.g., a few pounds, greater than 0.1 lbs., less than 10 lbs., about 1-4 lbs.) may be applied between the surface of the inking blanket 12 and the imaging member surface 22. At the fountain solution transfer nip 48, the fountain solution latent image 28 splits as it leaves the nip, and transfers a split layer of the fountain solution latent image, referred to as the transferred fountain solution latent image 50, to the transfer member surface (i.e., inking blanket 12). The amount of fountain solution transferred may be adjusted by contact pressure adjustments of nip 48. For example, a split fountain solution latent image 50 of about one (1) micrometer or less may be transferred to the inking blanket surface. Like the imaging member 16, the transfer member 14 may be electrically biased to enhance loading of the dampening fluid latent image at the loading nip 48.

After transfer of the fountain solution latent image from the imaging member 16, the imaging member 16 may be cleaned in preparation for a new cycle by removing dampening fluid and solid particles from the surface at a cleaning station 52. Various methods for cleaning the imaging member surface 22 may be used, for example an air knife and/or sponge, as well understood by a skilled artisan.

After the fountain solution latent image 50 is transferred to the transfer member 14, ink from an inker 54 is applied to the inking blanket 12 to form an ink pattern or image 18. The inker 54 is positioned downstream fountain solution transfer nip 48 to apply a uniform layer of ink over the transferred fountain solution latent image 50 and the inking blanket 12. While not being limited to a particular theory, the ink pattern or image 18 may be a negative of or may correspond to the fountain solution pattern. For example, the inker 54 may deposit the ink to the evaporated pattern representing the imaged portions of the reimageable surface 26, while ink deposited on the unformatted portions of the fountain solution will not adhere based on a hydrophobic and/or oleophobic nature of those portions. The ink image 18 may be transferred to print media or substrate 20 at an ink image transfer nip 56 formed by the transfer member 14 and a substrate transport roll 58. The substrate transport roll 58 may urge the print substrate 20 against the transfer member surface, or inking blanket 12, to facilitate contact transfer of the ink image 18 from the transfer member 14 to the print substrate.

After transfer of the ink image 18 from the transfer member 14 to the print media 20, residual ink may be removed by a cleaning device 60. This residual ink removal is most preferably undertaken without scraping or wearing the imageable surface of the imaging blanket 12. Removal of such remaining fluid residue may be accomplished through use of some form of cleaning device 60 adjacent the imaging blanket 12 between the ink image transfer nip 56 and the fountain solution transfer nip 48. Such a cleaning device 20 may include at least a first cleaning member such as a sticky or tacky roller in physical contact with the imaging blanket surface, with the sticky or tacky roller removing residual fluid materials (e.g., ink, fountain solution) from the surface. The sticky or tacky roller may then be brought into contact with a smooth roller (not shown) to which the residual fluids may be transferred from the sticky or tacky member, the fluids being subsequently stripped from the smooth roller by, for example, a doctor blade or other like device and collected as waste.

It is understood that the cleaning device 60 is one of numerous types of cleaning devices and that other cleaning devices designed to remove residual ink/fountain solution from the surface of imaging blanket 12 are considered within the scope of the embodiments. For example, the cleaning device could include at least one roller, brush, web, belt, tacky roller, buffing wheel, etc., as well understood by a skilled artisan. It is also understood that the cleaning device 60 may be more sophisticated or aggressive at removing residual fluids from imaging blanket 12 that the cleaning station 52 is at removing fountain solution from the surface 22 of the imaging member 16. Cleaning station 52 is not concerned with removing residual ink, and merely is designed to remove fountain solution and associated contaminates from the surface 22.

The exemplary ink-based digital image forming devices and operations thereof may be controlled by a controller 70 in communication with the image forming devices and parts thereof. For example, the controller 70 may control the imaging station 24 to create electrostatic charged patterns of latent images on the imaging member surface 22. Further, the controller 70 may control the aerosol development device 26 or other aerosol development devices discussed in greater detail below to provides the fog of charged fountain solution aerosol particles that are attracted to the electrostatic charged pattern. The controller 70 may be embodied within devices such as a desktop computer, a laptop computer, a handheld computer, an embedded processor, a handheld communication device, or another type of computing device, or the like. The controller 70 may include a memory, a processor, input/output devices, a display and a bus. The bus may permit communication and transfer of signals among the components of the controller 70 or computing device, as will be described in greater detail below.

Figure 2:
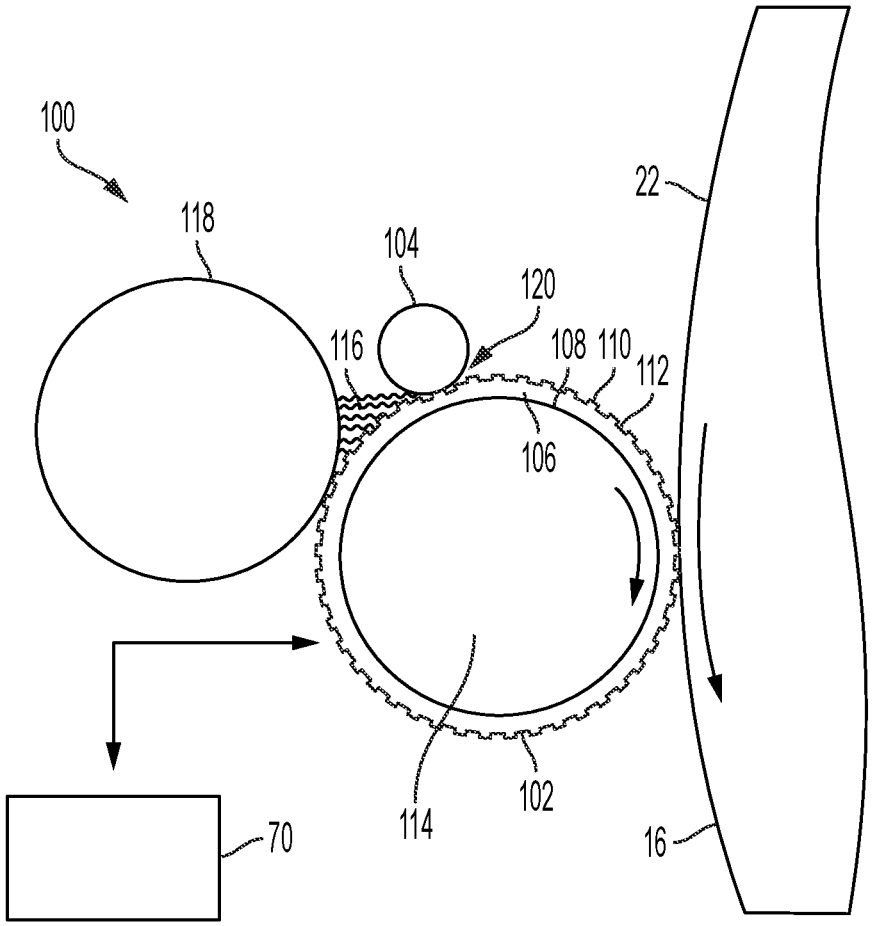
FIG. 2 is a side view partially in cross of a fountain solution delivery device in accordance with examples of the embodiments.
Figure 3:
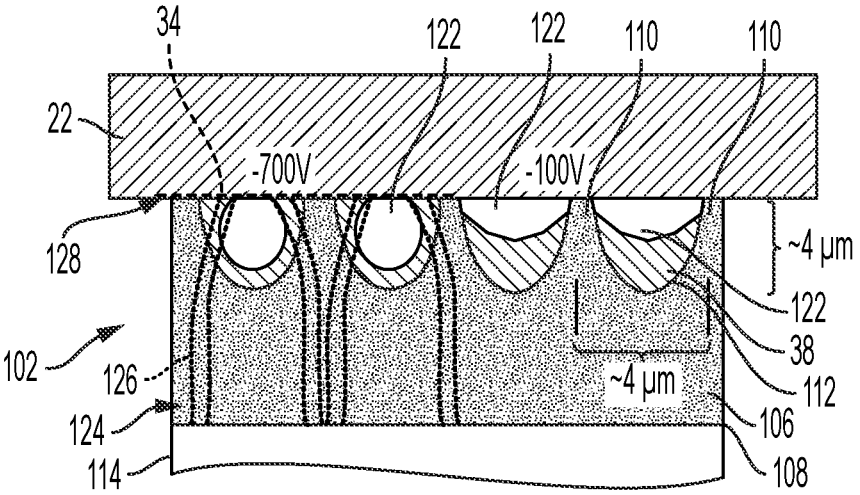
FIG. 3 is a side view in cross of an exemplary fountain solution transfer member textured compliant surface layer with dimples under-filled with fountain solution in accordance with examples of the embodiments.
Figure 4:
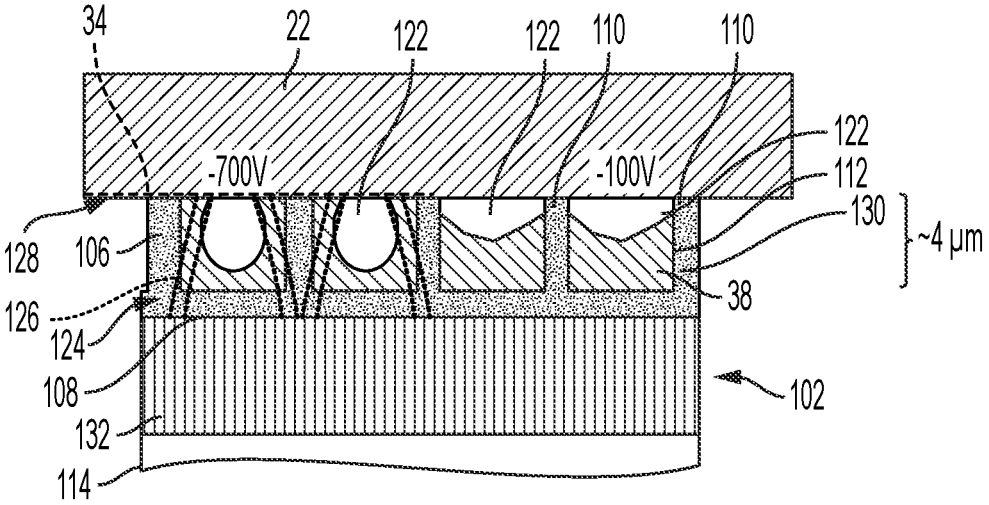
FIG. 4 is a side view in cross of another exemplary fountain solution transfer member textured compliant surface layer with dimples under-filled with fountain solution in accordance with examples of the embodiments.

FIGS. 2-4 depict additional approaches for delivering fountain solution 38 via dielectrophoresis onto a target (e.g., imaging member 16) having the charge-retentive surface 22 bearing electrostatic charged pattern 34. In lieu of the aerosol development device 26, examples include a fountain solution delivery device 100 having a fountain solution transfer member 102 and a metering member 104, as can be seen by example in FIG. 2. The fountain solution delivery device described in greater detail below present fountain solution 38 (e.g., silicone fluids, such as D4, D5, Isopar G, Isopar H, Dowsil OS20, Dowsil OS30, L5; water/IPA mixtures, hydrophilic fluids, and mixtures thereof) onto surface 22 of imaging member 16. There is no requirement that the fountain solution is charged, and the fountain solution may not be charged. The fountain solution 38 wets portions of the imaging member surface 22 and forms a latent image according to the electrostatic charged pattern 34 developed thereon by imager 32. Accordingly fountain solution delivery devices 100 may replace the aerosol development device 26 described above, and may associate with the controller 70 in similar manner. However, the approach to wetting the imaging member surface 22 by dielectrophoresis is different than by fog development, and there is no requirement that the fountain solution transferring from the transfer member 102 to the charge retentive surface is charged. Thus the transferring fountain solution may not be charged.

The fountain solution delivery devices may be part of an imaging system useful for printing with the ink-based digital image forming device 10 (FIG. 1) having rotatable imaging member 16 with a charge-retentive reimageable surface 22 bearing an electrostatic charged pattern 34 and a rotatable inking blanket 12 downstream the imaging member. The rotatable inking blanket 12 (or belt) has a surface in rolling communication with the charge-retentive surface 22 and may be conformable to accept the patterned fountain solution latent image 28 and transfer an ink image 18 corresponding to the electrostatic charged pattern 34 to a substrate 20. The inking blanket 12 may include, for example, hydrophobic polymers such as silicones, partially or fully fluorinated fluorosilicones and FKM fluoroelastomers. Other materials may be employed, including blends of polyurethanes, fluorocarbons, polymer catalysts, platinum catalyst, hydrosilyation catalyst, etc. The surface may be configured to conform to a print substrate on which an ink image is printed. To provide effective wetting of fountain solutions such as water-based dampening fluid, the silicone surface need not be hydrophilic, but may be hydrophobic. The inking blanket 12 may have high electrical resistivity and finite conductivity to avoid charge buildup on the blanket.

Referring to FIGS. 2-4, the fountain solution transfer member 102 has a textured compliant surface layer 106 wrapped around a conductive (e.g., metal, aluminum, steel, silver) layer 108. The textured compliant surface layer 106 has a thickness or depth (e.g., less than 100 microns, less than 50 microns, about 5-20 microns) and is textured with lands 110 at a top surface thereof and dimples 112 or pits therein. The dimples have a volume designed to receive and carry the fountain solution 38 to the charge retentive surface 22. The fountain solution transfer member 102 may refer to a textured roll having a pitted or textured surface layer with dimples in a matrix of lands, for example like anilox cells in the surface of an anilox roll. The transfer member 102 may be cylindrical, ellipsoidal, elliptical cylindrical, oblong cylindrical, spherical, oval cylindrical, parabolic cylindrical, hyperbolic cylindrical or any combination thereof. While not being limited to a particular configuration, the transfer member 102 may be similar in appearance to an anilox roll, but its surface layer 106 is compliant. The conformable textured surface layer 106 is formed over the conductive structural mounting layer 108 that may be, for example, a cylindrical, ellipsoidal or oblong cylindrical core 114, or one or more structural layers over the core. In examples, the conductive layer 108 may surround the core under the textured surface layer and may have a reference potential (e.g., ground, less than about −400V, about −100V). The core may be solid, rigid, compliant, hollow or some combination thereof, with hollowed core designed to allow fluid therein.

In examples, the textured surface layer 106 may be conformable (e.g., including silicone, PDMS, plastic, rubber), and may be an electrical insulator. The textured surface may be formed of a relatively thin layer (e.g., less than 100 microns, less than 50 microns, about 5-20 microns) over the mounting layer, a thickness of the relatively thin layer being selected to balance fountain solution particle transfer, durability and manufacturability. The textured compliant surface layer may have a high dielectric constant κ (e.g., more than 10, above one, more than about two) and may be loaded with high dielectric constant fillers (e.g., nano-titania, metal-oxide nano-particles, carbon nano-tubes, graphene flakes) as needed to have the high K. The fountain solution 38 in the dimples 112 may also have a high dielectric constant κ (e.g., more than 10, above one, more than about two). While not being limited to a particular theory, the dimples or anilox cells may be formed by embossment, etching, engraving, die casting, molding, laser ablation or other approaches understood by a skilled artisan. The dimples are not limited to a particular size and may have a diameter and/or depth of less than 100 microns, 1-10 microns, 2-5 microns or about 4 microns. The dimples may be deep enough to allow a layer of fountain solution 38 and a gap between the fountain solution and top surface of the lands, as will be described in greater detail below. Further, the dimples are not limited by shape, and may be hemispherical, cylindrical, semi-ellipsoidal, prism shaped, cone shaped, trapezoid prism, hexagonal, pyramidal, tetrahedronal, cuboidal, etc.

Fountain solution 38 is deposited uniformly within the dimples 112. For example, the fountain solution may be deposited into the dimples by any of several ways as understood by a skilled artisan, including by vapor condensation, doctor blading or roller application and metering. FIG. 2 illustrates an example with fountain solution 38 from a fountain solution supply (e.g., reservoir 116 defined by a roller 118 and transfer member 102) deposited into the dimples. The filling volume of the deposited fountain solution may be controlled to less than the full volume of the dimples 112, leaving a gap between the metered fountain solution and the top surface. In examples the filling volume may be controlled parametrically as understood by a skilled artisan. In examples the filling volume may be controlled via a self-limiting mode, e.g. by compressing the compliant surface layer lands 110 in the presence of the fountain solution 38 and allowing land expansion upon leaving the filling nip 120.

Without being limited to a particular theory, excess fountain solution 38 may be metered from the dimples by the metering member 104 (e.g, roller, doctor blade) pressing into the textured compliant surface layer 106 at nip 120 therebetween. Pressing with the metering member 104 into the dimples 112 filled with fountain solution may deform the compliant surface layer and reduce the volume of the dimples while also removing fountain solution from lands 110. As the compliant surface layer continues to rotate towards the imaging member 16 and beyond the nip 120, the surface layer expands and the volume of the dimples returns to its pre-compressed volume. This expansion creates gaps 122 (FIG. 3) in the dimples between the fountain solution 38 and the top surface lands 110. It is understood that other approaches are available to meter excess fountain solution from the dimples to create the gaps 122 (FIG. 3). For example, metering into the dimples with a metering member roller or blade that is more compliant than the textured top layer would also underfill the dimples as the more compliant metering member deforms into the dimples. As another example, if the textured top layer is relatively rigid, but resides on a relatively compliant core under layer, a compliant metering member roller or blade may be used to press into the dimples and remove excess fountain solution 38 before exiting and leaving the gaps.

FIG. 3 depicts an exemplary fountain solution transfer member 102 textured compliant surface layer 106 with dimples 112 under-filled with fountain solution 38 and lands 110 adjacent the charge retentive reimageable surface 22 of imaging member 16. The compliant surface layer may be formed by casting the layer (e.g., including silicone, PDMS, plastic, rubber) on a topographically patterned master, curing the layer and separating it from the patterned master. A back side of the compliant surface layer may then be bonded to a metalized or otherwise conductive support layer 108.

The compliant surface layer 106 may be rotated adjacent (e.g., in contact, next to, near) the charge retentive surface 22 during operation to wet the charge retentive surface at the electrostatic charged pattern 34 and form a patterned fountain solution latent image 28 on the charge-retentive surface based on the electrostatic charged pattern. The FIG. 3 shows the compliant surface layer 106 in contact with the charge retentive surface 22. It is understood that this is by example, and the touching is not required for the fountain solution 38 to wet the charge retentive surface by dielectrophoresis. It is also understood that while the compliant surface layer 106 is shown under the charge retentive surface 22 in examples (FIGS. 3, 4) and side-by-side in another example (FIG. 2), wetting of the charge retentive surface by the fountain solution in the dimples 112 is not limited to a particular orientation between the charge retentive surface and textured compliant surface layer.

In operation, the compliant surface layer 106 and charge retentive reimageable surface 22 rotate adjacent each other. When the charged regions of the electrostatic charged pattern are adjacent the under-filled dimples 112, the charged regions of the electrostatic charged pattern 34 and the conductive layer 108 create a non-uniform electric field 124 therebetween due to field concentration in the textured compliant surface layer 106. Electric field lines 126 that may be guided by dielectric variations defined by the dimple walls and the fountain solution form in the non-uniform electric field 124. The fountain solution 38 in dimples in the non-uniform electric field is attracted by force towards the charge retentive reimageable surface 22 at the highly charged regions (e.g., about −700V, greater than −400V). Force on the fountain solution arises from dielectrophoresis, which minimizes delivery device and imaging system energy by allowing the electric field lines 126 in the non-uniform electric field 124 to exist in the high dielectric (e.g., κ more than 10, above one, more than about two) textured compliant surface layer. Accordingly, the electrostatic charged pattern 34 regions in the non-uniform electric field 124 dielectrophoretically pull the fountain solution 38 in the dimples 112 across the gaps 122 to wet the charge retentive surface at the electrostatic charged pattern and form a patterned fountain solution latent image 28 on the charge-retentive surface based on the electrostatic charged pattern.

Fountain solution 38 in dimples not located in the non-uniform electric fields are not under the dielectrophoresis forces and remain in the dimples separated from the charge retentive reimageable surface 22 by the gaps 122. The charge retentive reimageable surface may be a photoreceptor generally understood to have fully charged regions at the electrostatic charged pattern regions and discharged regions where a discharged charge level may typically not be zero residual charge, but maybe about 10-20%, or less than 20% of the charged region. For ionographic surfaces of the charge retentive reimageable surface 22, uncharged regions may have very nearly zero charge. In examples where the electrostatic charged pattern 34 represents the negative of a desired image, the potential on conductive layer 108 may be optimally equal to the potential of the discharged (or uncharged) regions (e.g., less than about −200V, about −100V, ground). In examples where the electrostatic charged pattern 34 represents the desired image, the potential on conductive layer 108 may be optimally equal to the potential of the maximally charged regions (e.g., about −700V, greater than −400V).

FIG. 4 depicts another example of dielectrophoresis with the compliant surface layer 106 in contact with the charge retentive surface 22. In this example, the textured compliant surface layer 106 includes an outer layer of an epoxy-based negative photoresist 130 (e.g., SU-8) formed as a generally uniform thin layer (e.g., less than 20 microns, between 2 and 10 microns, about 4-6 microns) on conductive layer 108. The epoxy-based negative photoresist 130 may be loaded with high dielectric constant fillers (e.g., nano-titania, metal-oxide nano-particles, carbon nano-tubes, graphene flakes) to provide a high dielectric constant material (e.g., κ more than 10, above one, more than about two). The epoxy-based negative photoresist may be patterned using standard photolithographic approaches to provide dimples 112, as understood by a skilled artisan. While not being limited to a particular configuration, the dimples shown in the example depicted in FIG. 4 may be generally cylindrical and about 2-4 microns in diameter and depth.

The conductive layer 108 may be on a compliant backer layer 132 (e.g., including silicone, PDMS, plastic, rubber), which may be part of the compliant surface layer 106 or the core 114. The epoxy-based negative photoresist 130 (e.g., SU-8, Ordyl P-50100 dry film photoresist, off-stoichiometry thiol-enes (OSTE) polymer) may be relatively stiffer than the underlying compliant backer layer. The dimples may be underfilled as described above (e.g., vapor, more compliant roller or doctor blade than the negative photoresist, etc.) but the dimples do not deform when brought into contact with the charge retentive reimageable surface 22. The epoxy-based negative photoresist layer may conform to the macroscopic curvature of the charge retentive reimageable surface but the dimple volumes do not reduce.

In operation with the example shown in FIG. 4, as in FIG. 3, the compliant surface layer 106 and charge retentive reimageable surface 22 rotate adjacent each other such that when the charged regions of the electrostatic charged pattern are adjacent the under-filled dimples 112, the charged regions of the electrostatic charged pattern 34 and the conductive layer 108 create a non-uniform electric field 124 therebetween due to field concentration in the textured compliant surface layer 106. The fountain solution 38 in dimples in the non-uniform electric field is attracted by dielectrophoretic force towards the charge retentive reimageable surface 22 at the highly charged regions (e.g., −700V), while fountain solution 38 in dimples not located in the non-uniform electric fields are not under the same dielectrophoretic forces and remain in the dimples separated from the charge retentive reimageable surface 22 by the gaps 122. Thus the electrostatic charged pattern 34 regions in the non-uniform electric field 124 dielectrophoretically pull the fountain solution 38 in the dimples 112 across the gaps 122 to wet the charge retentive surface at the electrostatic charged pattern and form a patterned fountain solution latent image 28 on the charge-retentive surface based on the electrostatic charged pattern.

In examples, the textured compliant surface layer dimples 112 reside adjacent the charged regions of the electrostatic charged pattern 34 for a time long enough to wet the charged pixels in the charged regions to a desired volume or thickness of fountain solution coverage (e.g., less than 500 microns, about 20-200 microns, about 70-130 microns). The resident time for the charged regions and dimples to remain proximate to form sufficient non-uniform electric fields for dielectrophoretic transfer of fountain solution from the dimples to the surface 22 may be varied by control variables such as rotational speed, contact pressure—and thus nip length and contact dwell time, and charge densities on the charge retentive reimageable surface and the textured compliant surface layer 106, as understood by a skilled artisan.

After the fountain solution latent image 28 is developed on the charge retentive reimageable surface 22, the imaging member 16 is brought in rolling contact with the inked image transfer member 14 at the fountain solution transfer nip 48 (FIG. 1), where the fountain solution latent image splits to supply the inking blanket 12 with the desired latent image coverage. Ink is applied to the latent image on the inking blanket, resulting in an ink image 18 that may be transferred to print media or substrate 20 at an ink image transfer nip 56, as described above.

Figure 5:
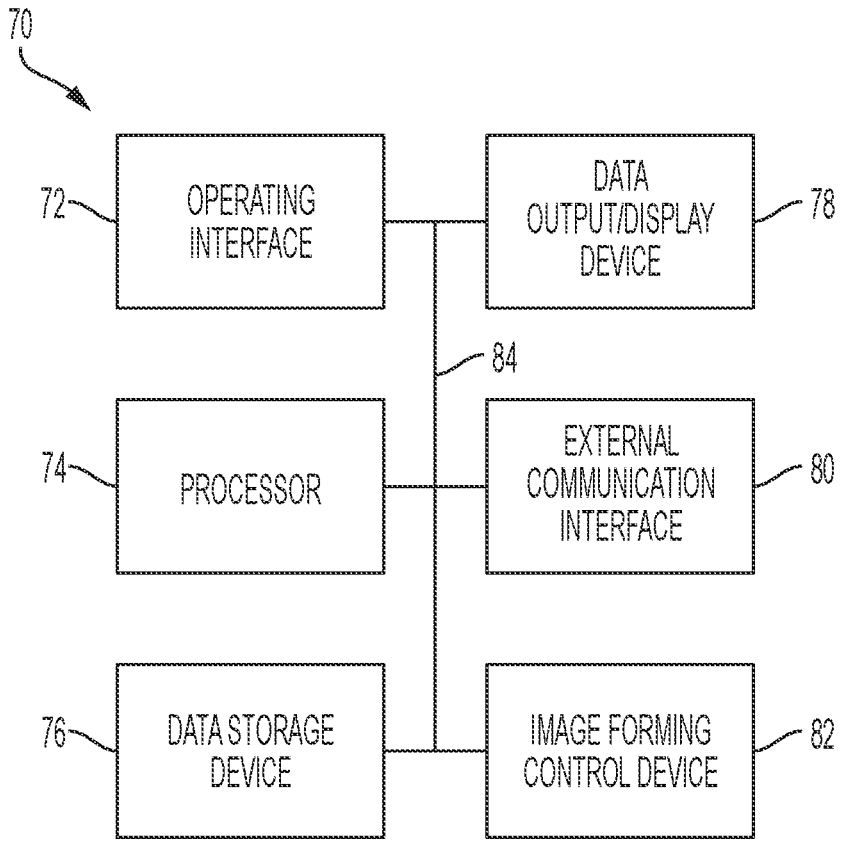
FIG. 5 is a block diagram of a controller with a processor for executing instructions to automatically control components of the digital image forming device and fountain solution delivery device depicted in FIGS. 1-4.

FIG. 5 illustrates a block diagram of the controller 70 for executing instructions to automatically control the ink-based digital image forming device 10, fountain solution delivery devices 100 and components thereof. The exemplary controller 70 may provide input to or be a component of a controller for executing image formation methods in a system such as that depicted in FIGS. 1-4 and described in greater detail below in FIG. 6.

The exemplary controller 70 may include an operating interface 72 by which a user may communicate with the exemplary control system. The operating interface 72 may be a locally-accessible user interface associated with the digital image forming device 10 and fountain solution delivery devices 100. The operating interface 72 may be configured as one or more conventional mechanism common to controllers and/or computing devices that may permit a user to input information to the exemplary controller 70. The operating interface 72 may include, for example, a conventional keyboard, a touchscreen with "soft" buttons or with various components for use with a compatible stylus, a microphone by which a user may provide oral commands to the exemplary controller 70 to be "translated" by a voice recognition program, or other like device by which a user may communicate specific operating instructions to the exemplary controller. The operating interface 72 may be a part or a function of a graphical user interface (GUI) mounted on, integral to, or associated with, the digital image forming device 10 and fountain solution delivery devices 100 with which the exemplary controller 70 is associated.

The exemplary controller 70 may include one or more local processors 74 for individually operating the exemplary controller 70 and for carrying into effect control and operating functions for image formation onto a print substrate 20, including but not limited to forming an electrostatic charged pattern 34 on the charge retentive reimageable surface 22, metering fountain solution in dimples 112, creating non-uniform electric fields in high dielectric compliant transfer member compliant surface layers, transferring metered fountain solution onto the charge retentive reimageable surface 22 to form a fountain solution latent image 28, transferring the latent image from the imaging member 16 to an inking blanket 12 surface of an inked image transfer member 14, depositing a layer of ink over the latent image to form an ink image 18 and transferring the ink image from the inking blanket to print substrate 20. Processor(s) 74 may include at least one conventional processor or microprocessor that interprets and executes instructions to direct specific functioning of the exemplary controller 70, and control of the image forming process with the exemplary controller.

The exemplary controller 70 may include one or more data storage devices 76. Such data storage device(s) 76 may be used to store data or operating programs to be used by the exemplary controller 70, and specifically the processor(s) 74. Data storage device(s) 76 may be used to store information regarding, for example, a current image for patterning by the imaging station 24, desired and actual fountain solution metering transfer parameters, charge density of the charge-retentive surface 22 and conductive layer 108, and digital image information with which the digital image forming device 10 and fountain solution delivery devices 100 are associated.

The data storage device(s) 76 may include a random access memory (RAM) or another type of dynamic storage device that is capable of storing updatable database information, and for separately storing instructions for execution of image forming operations by, for example, processor(s) 74. Data storage device(s) 76 may also include a read-only memory (ROM), which may include a conventional ROM device or another type of static storage device that stores static information and instructions for processor(s) 74. Further, the data storage device(s) 76 may be integral to the exemplary controller 70, or may be provided external to, and in wired or wireless communication with, the exemplary controller 70, including as cloud-based data storage components.

The data storage device(s) 76 may include non-transitory machine-readable storage medium to store the device queue manager logic persistently. While a non-transitory machine-readable storage medium is may be discussed as a single medium, the term "machine-readable storage medium" should be taken to include a single medium or multiple media (e.g., a centralized or distributed database, and/or associated caches and servers) that store one or more sets of instructions. The term "machine-readable storage medium" shall also be taken to include any medium that is capable of storing or encoding a set of instruction for execution by the controller 70 and that causes the digital image forming device 10 and fountain solution delivery devices 100 to perform any one or more of the methodologies of the present invention. The term "machine-readable storage medium" shall accordingly be taken to include, but not be limited to, solid-state memories, and optical and magnetic media.

The exemplary controller 70 may include at least one data output/display device 78, which may be configured as one or more conventional mechanisms that output information to a user, including, but not limited to, a display screen on a GUI of the digital image forming device 10, fountain solution delivery devices 100, and/or associated image forming devices with which the exemplary controller 70 may be associated. The data output/display device 78 may be used to indicate to a user a status of the digital image forming device 10 with which the exemplary controller 70 may be associated including an operation of one or more individually controlled components at one or more of a plurality of separate image processing stations or subsystems associated with the image forming device.

The exemplary controller 70 may include one or more separate external communication interfaces 80 by which the exemplary controller 70 may communicate with components that may be external to the exemplary control system such as a temperature sensor, printer or other image forming device. At least one of the external communication interfaces 80 may be configured as an input port to support connecting an external CAD/CAM device storing modeling information for execution of the control functions in the image formation operations. Any suitable data connection to provide wired or wireless communication between the exemplary controller 70 and external and/or associated components is contemplated to be encompassed by the depicted external communication interface 80.

The exemplary controller 70 may include an image forming control device 82 that may be used to control the image forming process to render ink images on the print substrate 20. For example, the image forming control device 82 may: control the imaging station 24 to form an electrostatic charged pattern 34 on the charge retentive reimageable surface 22, control the fountain solution delivery devices 100 to form fountain solution latent images including fountain solution metering and transfer volume. The image forming control device 82 may operate as a part or a function of the processor 74 coupled to one or more of the data storage devices 76, the digital image forming device 10 and fountain solution delivery devices 100, or may operate as a separate stand-alone component module or circuit in the exemplary controller 70.

All of the various components of the exemplary controller 70, as depicted in FIG. 5, may be connected internally, and to the digital image forming device 10, fountain solution delivery devices 100, and/or components thereof, by one or more data/control busses 84. These data/control busses 84 may provide wired or wireless communication between the various components of the image forming device 10, fountain solution delivery devices 100, and any associated image forming apparatus, whether all of those components are housed integrally in, or are otherwise external and connected to image forming devices with which the exemplary controller 70 may be associated.

It should be appreciated that, although depicted in FIG. 5 as an integral unit, the various disclosed elements of the exemplary controller 70 may be arranged in any combination of sub-systems as individual components or combinations of components, integral to a single unit, or external to, and in wired or wireless communication with the single unit of the exemplary control system. In other words, no specific configuration as an integral unit or as a support unit is to be implied by the depiction in FIG. 5. Further, although depicted as individual units for ease of understanding of the details provided in this disclosure regarding the exemplary controller 70, it should be understood that the described functions of any of the individually-depicted components, and particularly each of the depicted control devices, may be undertaken, for example, by one or more processors 74 connected to, and in communication with, one or more data storage device(s) 76.

Figure 6:
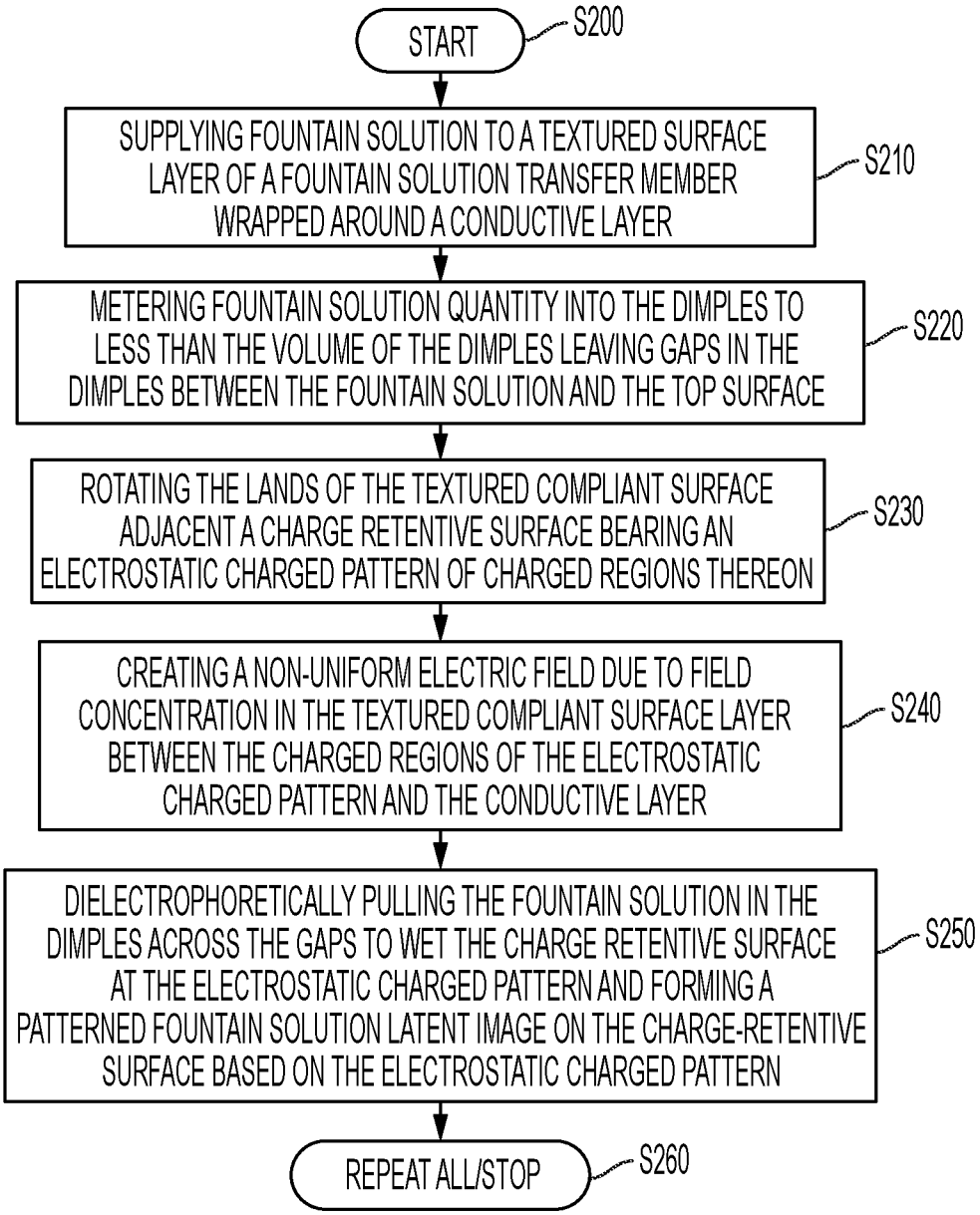
FIG. 6 is a flowchart depicting the operation of a fountain solution delivery device in accordance with examples.

The disclosed embodiments may include an exemplary method for delivering fountain solution onto a target having a charge-retentive surface bearing an electrostatic charged pattern of charged regions thereon, with the target part of the digital image forming device 10 from which an inked image may be printed. FIG. 6 illustrates a flowchart of such an exemplary method. As shown in FIG. 6, operation of the method commences at Step S200 and proceeds to Step S210.

At Step S210 fountain solution is supplied to a fountain solution transfer member having a textured compliant surface layer of a first depth wrapped around a conductive layer. The textured compliant surface layer includes lands at a top surface thereof and dimples therein configured to receive and carry the fountain solution. The textured compliant surface layer may include high dielectric constant fillers, such as nano-titania, metal-oxide nano-particles, carbon nano-tubes, and graphene flakes. The conductive layer has a reference potential, and each dimple having a volume. In examples, the textured compliant surface layer may include an epoxy-based negative photoresist outer layer, such as a SU-8 layer. The surface layer may further include a compliant backing layer surrounded by the conductive layer.

Operation of the method may proceed to Step S220, where fountain solution in the dimples is metered to less than the volume of the dimples leaving gaps in the dimples between the fountain solution and the top surface. A metering member may remove excess fountain solution from the textured surface layer and dimples with a metering member in contact with the surface layer lands to form a nip therebetween. The metering member may compress the textured compliant surface layer to a second depth less than the first depth with the metering member at the nip and separating from the compressed textured compliant surface layer downstream the nip to allow surface layer expansion back to the first depth. In examples, the metering member may be more compliant than the textured compliant surface layer to dip into the dimples and remove excess fountain solution therefrom.

Operation of the method may proceed to Step S230, where the lands of the textured compliant surface are rotated adjacent the charge retentive surface to place the underfilled dimples next to or in contact with the electrostatic charged pattern of charged regions on the charge-retentive surface. Operation may proceed to Step S240, where the charged regions on the charge-retentive surface and the conductive layer of the fountain solution transfer member create a non-uniform electric field therebetween due to field concentration in the textured compliant surface layer. In examples, the potential of the conductive may be set to substantially equal the potential of areas of the charge retentive surface other than the charged regions of the electrostatic charged pattern. In other examples, the potential of the conductive may be set to substantially equal the potential of the charged regions of the charge retentive surface.

Operation of the method may proceed to Step S250, where the charged regions in the non-uniform electric field dielectrophoretically pull the fountain solution in the dimples across the gaps to wet the charge retentive surface at the electrostatic charged pattern and form a patterned fountain solution latent image on the charge-retentive surface based on the electrostatic charged pattern. The fountain solution in the underfilled dimples dielectrophoretically pulled across the gaps may be uncharged. The latent image may be a positive image or negative image and may be transferred from the charge-retentive surface to a transfer member inking blanket for forming an inked image thereon based on the electrostatic charged pattern. Operation may cease at Step S260, or may continue by repeating back to Step S210, for delivering additional fountain solution onto the target.

The exemplary depicted sequence of executable method steps represents one example of a corresponding sequence of acts for implementing the functions described in the steps. The exemplary depicted steps may be executed in any reasonable order to carry into effect the objectives of the disclosed embodiments. No particular order to the disclosed steps of the method is necessarily implied by the depiction in FIG. 6, and the accompanying description, except where any particular method step is reasonably considered to be a necessary precondition to execution of any other method step. Individual method steps may be carried out in sequence or in parallel in simultaneous or near simultaneous timing. Additionally, not all of the depicted and described method steps need to be included in any particular scheme according to disclosure.

Those skilled in the art will appreciate that other embodiments of the disclosed subject matter may be practiced with many types of image forming elements common to offset inking system in many different configurations. For example, although digital lithographic systems and methods are shown in the discussed embodiments, the examples may apply to analog image forming systems and methods, including analog offset inking systems and methods. It should be understood that these are non-limiting examples of the variations that may be undertaken according to the disclosed schemes. In other words, no particular limiting configuration is to be implied from the above description and the accompanying drawings.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A method for delivering fountain solution onto a target having a charge-retentive surface bearing an electrostatic charged pattern of charged regions thereon, comprising:

a) supplying fountain solution to a fountain solution transfer member having a textured compliant surface layer of a first depth wrapped around a conductive layer, the textured compliant surface layer having lands at a top surface thereof and dimples therein configured to receive and carry the fountain solution, the conductive layer having a reference potential, each dimple having a volume;

b) metering fountain solution quantity into the dimples to less than the volume of the dimples leaving gaps in the dimples between the fountain solution and the top surface;

c) rotating the lands of the textured compliant surface adjacent the charge retentive surface;

d) creating a non-uniform electric field due to field concentration in the textured compliant surface layer between the charged regions of the electrostatic charged pattern and the conductive layer; and e) the charged regions in the non-uniform electric field dielectrophoretically pulling the fountain solution in the dimples across the gaps to wet the charge retentive surface at the electrostatic charged pattern and forming a patterned fountain solution latent image on the charge-retentive surface based on the electrostatic charged pattern.

2. The method of claim 1, the Step b) including metering excess fountain solution from the textured surface layer of the fountain solution transfer member resulting in a metered layer of fountain solution in the dimples of the textured surface layer with a metering member in contact with the fountain solution transfer member lands to form a nip therebetween.

3. The method of claim 2, the Step b) further including the metering member compressing the textured compliant surface layer to a second depth less than the first depth with the metering member at the nip and separating from the compressed textured compliant surface layer downstream the nip to allow surface layer expansion back to the first depth.

4. The method of claim 1, further comprising, before Step c), forming the electrostatic charged pattern of charged regions on the charge-retentive surface with an image forming unit adjacent the charge-retentive surface.

5. The method of claim 1, further comprising setting the potential of the conductive layer to be the same as that of the potential of areas of the charge retentive surface other than the charged regions of the electrostatic charged pattern.

6. The method of claim 1, wherein the fountain solution in the dimples dielectrophoretically pulled across the gaps is uncharged.

7. The method of claim 1, further comprising transferring the patterned fountain solution latent image on the charge-retentive surface to a transfer member inking blanket for forming an inked image thereon based on the electrostatic charged pattern.

8. The method of claim 1, further comprising, before Step a), loading the textured compliant surface layer with high dielectric constant fillers including one of nano-titania, metal-oxide nano-particles, carbon nano-tubes, and graphene flakes.

9. The method of claim 1, wherein the textured compliant surface layer includes a SU-8 layer.

10. A fountain solution delivery device for delivering fountain solution onto a target having a charge-retentive surface bearing an electrostatic charged pattern of charged regions thereon, the fountain solution delivery device comprising:

a fountain solution transfer member including a textured compliant surface layer of a first depth wrapped around a conductive layer, the textured compliant surface layer having lands at a top surface thereof and dimples therein configured to receive and carry the fountain solution, the conductive layer having a reference potential, each dimple having a volume, the textured compliant surface layer configured to have fountain solution filling the dimples thereon; and a metering member in contact with the fountain solution transfer member, the metering member configured to meter fountain solution quantity in the dimples to less than the volume of the dimples leaving gaps in the dimples between the fountain solution and the top surface;

wherein the fountain solution transfer member is rotatable adjacent the charge retentive surface at the charged regions of the electrostatic charged pattern, with the charged regions and the conductive layer creating a non-uniform electric field therebetween due to field concentration in the textured compliant surface layer, and the charged regions in the non-uniform electric field being configured to dielectrophoretically pull the fountain solution in the dimples across the gaps to wet the charge retentive surface at the electrostatic charged pattern and form a patterned fountain solution latent image on the charge-retentive surface based on the electrostatic charged pattern.

11. The device of claim 10, the metering member further configured to meter excess fountain solution from the textured surface layer of the fountain solution transfer member to result in a metered layer of fountain solution in the dimples of the textured surface layer with the metering member in contact with the fountain solution transfer member lands to form a nip therebetween.

12. The device of claim 11, the textured compliant surface layer being compressed by the metering member at the nip to a second depth less than the first depth at the nip and expended back to the first depth downstream the nip where the metering member and textured compliant surface layer are spatially separate.

13. The device of claim 10, further comprising an image forming unit adjacent the charge-retentive reimageable surface that forms the electrostatic charged pattern on the charge-retentive reimageable surface.

14. The device of claim 10, wherein the textured compliant surface layer includes high dielectric constant fillers including one of nano-titania, metal-oxide nano-particles, carbon nano-tubes, and graphene flakes.

15. The device of claim 10, wherein the textured compliant surface layer includes a SU-8 layer patterned to form the dimples.

16. The device of claim 15, the fountain solution transfer member further including a compliant backer layer surrounded by the conductive layer.

17. The device of claim 10, further comprising the fountain solution, wherein the fountain solution in the dimples is uncharged.

18. The device of claim 10, wherein the conductive support layer has an electric potential set to be the same as the electric potential of regions of the charge retentive surface other than the charged regions.

19. The device of claim 10, wherein the metering member is more compliant than the textured compliant surface layer and the metering member is configured to deform into the dimples to meter the fountain solution quantity in the dimples to less than the volume of the dimples.

20. An imaging system useful for printing with an ink-based image forming apparatus having a rotatable imaging member with a charge-retentive surface bearing an electrostatic charged pattern of charged regions thereon, the system comprising:

an image forming unit adjacent the charge-retentive reimageable surface that forms the electrostatic charged pattern on the charge-retentive reimageable surface;

a fountain solution transfer member including a textured compliant surface layer of a first depth wrapped around a conductive layer, the textured compliant surface layer having lands at a top surface thereof and dimples therein configured to receive and carry the fountain solution, the conductive layer having a reference potential, each dimple having a volume, the textured compliant surface layer configured to have fountain solution filling the dimples thereon; and a metering member in contact with the fountain solution transfer member, the metering member configured to meter fountain solution quantity in the dimples to less than the volume of the dimples leaving gaps in the dimples between the fountain solution and the top surface, the metering member further configured to meter excess fountain solution from the textured surface layer of the fountain solution transfer member to result in a metered layer of fountain solution in the dimples of the textured surface layer with the metering member in contact with the fountain solution transfer member lands to form a nip therebetween;

wherein the fountain solution transfer member is rotatable adjacent the charge retentive surface at the charged regions of the electrostatic charged pattern, with the charged regions and the conductive layer creating a non-uniform electric field therebetween due to field concentration in the textured compliant surface layer, and the charged regions in the non-uniform electric field being configured to dielectrophoretically pull the fountain solution in the dimples across the gaps to wet the charge retentive surface at the electrostatic charged pattern and form a patterned fountain solution latent image on the charge-retentive surface based on the electrostatic charged pattern.

* * * * *